US008776859B2

(12) United States Patent
Frederick

(10) Patent No.: US 8,776,859 B2
(45) Date of Patent: Jul. 15, 2014

(54) SAFETY DEVICE FOR WINDOW COVERING OPERATOR

(76) Inventor: James G. Frederick, Maineville, OH (US)

( * ) Notice: Subject to any disclaimer, the term of this patent is extended or adjusted under 35 U.S.C. 154(b) by 314 days.

(21) Appl. No.: 12/914,403

(22) Filed: Oct. 28, 2010

(65) Prior Publication Data

US 2011/0094065 A1 Apr. 28, 2011

Related U.S. Application Data

(60) Provisional application No. 61/255,602, filed on Oct. 28, 2009.

(51) Int. Cl.
*E06B 9/30* (2006.01)

(52) U.S. Cl.
USPC ..... 160/178.1 R; 160/173 R

(58) Field of Classification Search
USPC ..... 160/321, 320, 178.1 R, 193
See application file for complete search history.

(56) References Cited

U.S. PATENT DOCUMENTS 3,022,819 A * 2/1962 Lampret ..... 160/345
3,129,715 A 4/1964 Militano et al.
3,593,772 A 7/1971 Abraham
3,671,016 A 6/1972 Gladysz
4,126,912 A * 11/1978 Johnson ..... 16/81
4,653,567 A 3/1987 Starcke et al.
4,909,298 A 3/1990 Langhart et al.
5,125,447 A 6/1992 Suggs
5,465,775 A 11/1995 Biba et al.
5,465,779 A 11/1995 Rozon
5,472,035 A 12/1995 Biba et al.
5,495,883 A 3/1996 Jelic
5,513,687 A 5/1996 Tuzmen et al.
5,518,198 A 5/1996 Chumbley et al.
5,613,540 A 3/1997 Jelic
5,676,188 A 10/1997 Cadorette
5,718,277 A 2/1998 Prosch
5,722,478 A 3/1998 Claypool et al.
5,752,558 A * 5/1998 Lin ..... 160/320
5,778,957 A 7/1998 Torgersen
5,797,441 A 8/1998 Benthin
5,845,696 A * 12/1998 Chou ..... 160/178.1 V
6,085,824 A 7/2000 Cadorette
6,158,494 A 12/2000 Huang
6,463,987 B1 10/2002 Nevins
6,516,860 B1 2/2003 Weaver et al.
6,792,995 B2 9/2004 Judkins
6,918,424 B2 7/2005 Lin
7,063,122 B2 6/2006 Colson et al.
7,096,918 B2 8/2006 Lin (Continued)

OTHER PUBLICATIONS

Rollease, Inc., Letter to Friends and Customers of RollEase dated Sep. 3, 2009, Instructions: RollEase WCMA—ANSI 6.5 Compliant Tension Device, May 5, 2009 (2 pages).

*Primary Examiner* — Blair M. Johnson
(74) *Attorney, Agent, or Firm* — Wood, Herron & Evans, LLP

(57) ABSTRACT

A safety device for use with a control loop of a window covering includes one or a pair of rigid elongated housings configured to be mounted in a fixed vertical orientation adjacent one side of the window covering. Each elongated housing defines a longitudinal channel therein that is configured to receive portions of the control loop therein so as to prevent small children from becoming entangled with or strangled by the control loop.

22 Claims, 4 Drawing Sheets

(56) References Cited

U.S. PATENT DOCUMENTS

| | | | | |
|---|---|---|---|---|
| 7,311,132 | B2 | 12/2007 | Corey et al. | |
| 7,520,311 | B2 | 4/2009 | Drew | |
| 7,793,700 | B2 * | 9/2010 | Bossler | 160/173 R |
| 8,286,686 | B2 * | 10/2012 | Cannaverde | 160/320 |
| 8,662,136 | B2 * | 3/2014 | Nevins | 160/178.1 R |
| 2004/0123958 | A1 | 7/2004 | Krug | |
| 2005/0092448 | A1 | 5/2005 | Lin | |
| 2011/0094065 | A1 * | 4/2011 | Frederick | 24/115 F |

* cited by examiner

SAFETY DEVICE FOR WINDOW COVERING OPERATOR

This application claims the filing benefit of co-pending U.S. Provisional Application Ser. No. 61/255,602, filed Oct. 28, 2009, entitled ENCLOSURE FOR ROLLER SHADE DRIVE CHAIN, the disclosure of which is incorporated herein by reference in its entirety.

FIELD OF THE INVENTION

The present invention relates generally to safety devices and, more particularly, to a safety device for use with window coverings that are operated by a control loop.

BACKGROUND OF THE INVENTION

Vertical and horizontal shades or blinds are conventional decorative window coverings that provide comfort by filtering the sunlight entering a room through a window. There are various styles of vertical and horizontal shades or blinds, such as rollers with a single panel construction or Roman or Venetian blinds having multiple panel or slat constructions. Many styles of window shades or blinds are retractable while other styles, such as Venetian blinds, may also be retractable and have rotatable slats for filtering light.

With many types of vertical and horizontal shades or blinds, a control loop, such as a control chain or cord, may be used for operating the window shade or blind. The control loop, or multiple control loops when multiple window shades or blinds are operated on the same window, often extends vertically adjacent one side of the window shade or blind for ready access by an operator. Each control loop has two vertical runs so that an operator can pull on one run to cause the shade or blind to retract or open, and pull on the other run to cause the shade or blind to lower or close.

For those styles of window shades or blinds with rotatable slats, adjustments are made to control the amount of light entering a room through the window by rotating each slat. In a fully open orientation of the slats, the maximum amount of light passes into the room through the window. Conversely, by rotating the slats to a fully closed orientation, the minimum amount of light passes into the room through the window as the light is essentially blocked. Rotation of the slats may occur by way of another control loop, such as a control chain or cord. The control loop for controlling rotation of the slats may also extend vertically on one side of the window shade or blind and have two vertical runs for ready access by an operator.

Known control loops typically form a continuous loop adjacent one or both sides of the window, with the control loop having two vertical runs and an end loop located at the lower end of the control loop. While this configuration for the control loop provides for easy operation of the window shade or blind by an operator, the control loop may pose a threat to small children since the children may become entangled with or strangled by the control loop when they place their heads between the pair of vertical runs. On the other hand, older children, i.e., those typically beyond the toddler years, typically have sufficient strength and coordination to detangle themselves from a control loop should that accidentally occur.

While several known control loop safety devices have been developed in the past in an attempt to reduce the threat associated with these types of control loops, there are still problems and drawbacks with these known safety devices that need to be addressed and better solutions proffered.

SUMMARY OF THE INVENTION

The present invention overcomes the foregoing and other shortcomings and drawbacks of control loop safety devices heretofore known. While the invention will be described in connection with certain embodiments, it will be understood that the invention is not limited to these embodiments. On the contrary, the invention includes all alternatives, modifications, and equivalents as may be included within the spirit and scope of the present invention.

The present invention is directed to a safety device for use with a control loop of a window covering. The control loop has a pair of vertical runs and an end loop, and is connected to a control assembly mounted in a headrail of the window covering.

In one embodiment, the safety device includes a rigid elongated housing that is configured to be mounted in a fixed vertical orientation adjacent one side of the window covering. The elongated housing defines a longitudinal channel therein that is configured to receive portions of the pair of vertical runs and the end loop of the control loop within the channel.

A tension member is mounted within the channel and fixed in vertical location relative to the elongated housing. The tension member is configured to engage the end loop of the control loop to effectively provide tension to the control loop.

The upper end of the safety device includes an access opening through which the control loop extends into the channel. The length of the elongated housing may vary as needed to position the access opening at a height within the range of about 48 inches to about 60 inches above the floor so that the access opening is located above the head of most small children. In this way, the safety device encloses the control loop within the elongated housing so that the vertical runs of the control loop are only accessible by an operator, such as an adult or older child, above the access opening at the height in the range of about 48 inches and about 60 inches above the floor. This significantly reduces the likelihood that small children could become entangled with or strangled by the control loop since access to the control loop is prevented below the access opening.

In an alternative embodiment, a safety device for use with a control loop of a window covering includes a first rigid elongated housing that is configured to be mounted in a fixed vertical orientation adjacent one side of the window covering. The first elongated housing defines a first longitudinal channel therein configured to receive portions of the pair of vertical runs of the control loop within the first channel. The safety device further includes a second rigid elongated housing configured to be mounted in a fixed vertical orientation adjacent the one side of the window covering. The second elongated housing defines a second longitudinal channel therein that is configured to receive other portions of the pair of vertical runs and the end loop of the control loop within the second channel.

The first and second elongated housings are spaced vertically from each other so as to be separated by a gap. The gap is configured to expose the pair of vertical runs of the control loop between the first and second elongated housings.

The gap may have a gap width in the range of about 12 inches and 18 inches so that the control loop may be accessed by a disabled operator at a height of about 36 inches above the floor. The width of the gap is selected so that a smaller child cannot place his or her head within the gap or otherwise pull the control loop out of the gap so as to become entangled with or strangled by the control loop.

The access opening of the upper elongated housing is located at a height in a range of about 48 inches and about 60 inches above the floor so as an adult or older child can readily access the control loop above the access opening while smaller children are protected against accidental entanglement with or strangulation by the control loop.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
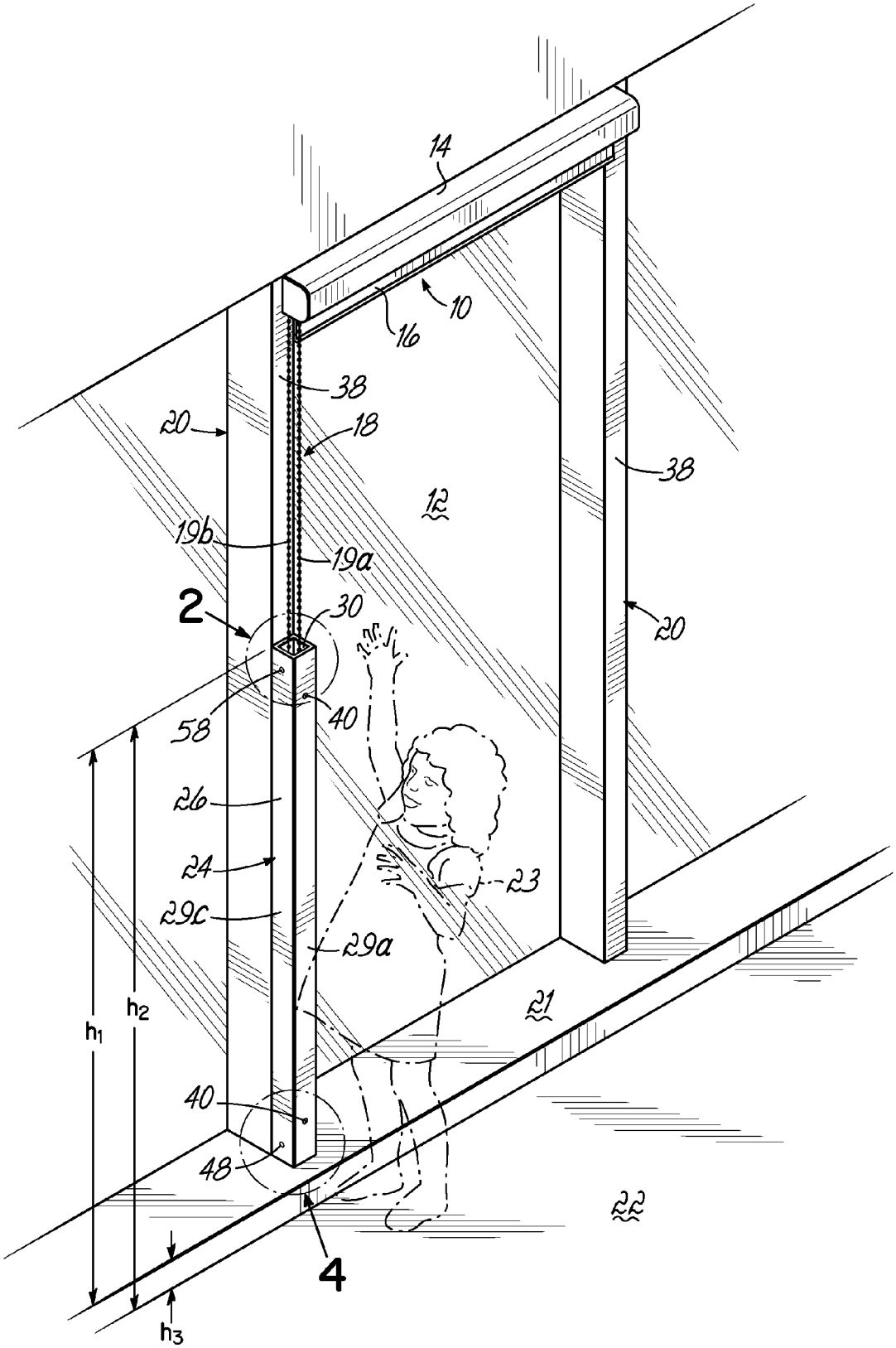
FIG. 1 is a perspective view of a control loop safety device, shown installed on a mullion of a window, according to one embodiment of the present invention.

Referring now to the figures, and to FIG. 1 in particular, a window covering, such as a roller shade 10 in one exemplary embodiment, is shown installed on a window 12. The roller shade 10 includes a headrail 14 having a control assembly (not shown) for controlling operation of the roller shade 10, a shade 16 and at least one control loop 18 depending vertically from the headrail 14 adjacent one side of the roller shade 10. As will be appreciated by those of ordinary skill in the art, the control loop 18 may comprise a continuous cord or chain having a pair of vertical runs 19*a*, 19*b* and an end loop 19*c* (FIG. 4) located at a lower end of the control loop 18. Alternatively, the control loop 18 may comprise two freely dangling cords or chains having their ends tied or otherwise connected together to form a continuous loop.

It will be appreciated that while a roller shade 10 is shown in the exemplary embodiment, the window covering may comprise any type of vertical or horizontal blind or shade that may be vertically raised or lowered, or moved horizontally, through operation of a control loop as known to those of ordinary skill in the art.

As shown in FIG. 1, the roller shade 10 may be mounted or installed on a pair of vertical mullions 20, near the top of the window 12. The control loop 18 may extend most of the length of the window 12, or nearly to a base 21 of the mullions 20 (or otherwise to the floor 22 or a window sill (not shown)) where it would be easily accessible by a child 23.

In accordance with the principles of the present invention, and according to one embodiment, a control loop safety device 24 is mounted in a vertical orientation to one of the mullions 20 to prevent small children, such as a child 23 (FIG. 1), from becoming entangled with or strangled by the control loop 18 as will be described in detail below.

The safety device 24 comprises in one embodiment a rigid elongated housing 26 having a rectangular cross-sectional profile and defining a single channel 28 (FIG. 2) therein along the length of the safety device 24 for receiving a portion of the control loop 18 within the channel 28. Of course, other cross-sectional profiles, including square, semi-circular or other suitable cross-sectional profiles, are possible as well.

In one embodiment, the elongated housing 26 may be constructed as an extruded aluminum tube having the desired cross-sectional profile. In the exemplary embodiment of the safety device 24 shown in FIGS. 1, 2 and 4, the safety device 24 has a front wall 29*a*, an opposite rear wall 29*b*, and a pair of opposite side walls 29*c*, 29*d* connected to the front and rear walls 29*a*, 29*b*, respectively (see FIGS. 2 and 4). The width (i.e., the width in the depth direction) of the side walls 29*c*, 29*d* of the safety device 24 may vary according to the dimensions of the mullions 20 and/or to the configuration of the control loop 18, but may generally range from about 2 inches to about 4 inches. The cross-width dimension of the front and rear walls 24*a*, 24*b* may vary between 1 inch and 2 inches. Of course, other width dimensions of front and rear walls 29*a*, 29*b* and/or the pair of side walls 29*c*, 29*d*, are possible as well without departing from the spirit and scope of the present invention. The cross-section dimensions of the safety device 24 may comprise, for square or rectangular profiles, 1 inch×2 inches, 1 inch×4 inches, 2 inches×2¼ inches, 2 inches×4 inches, or 2½ inches×4 inches, by way of example.

Figure 6:
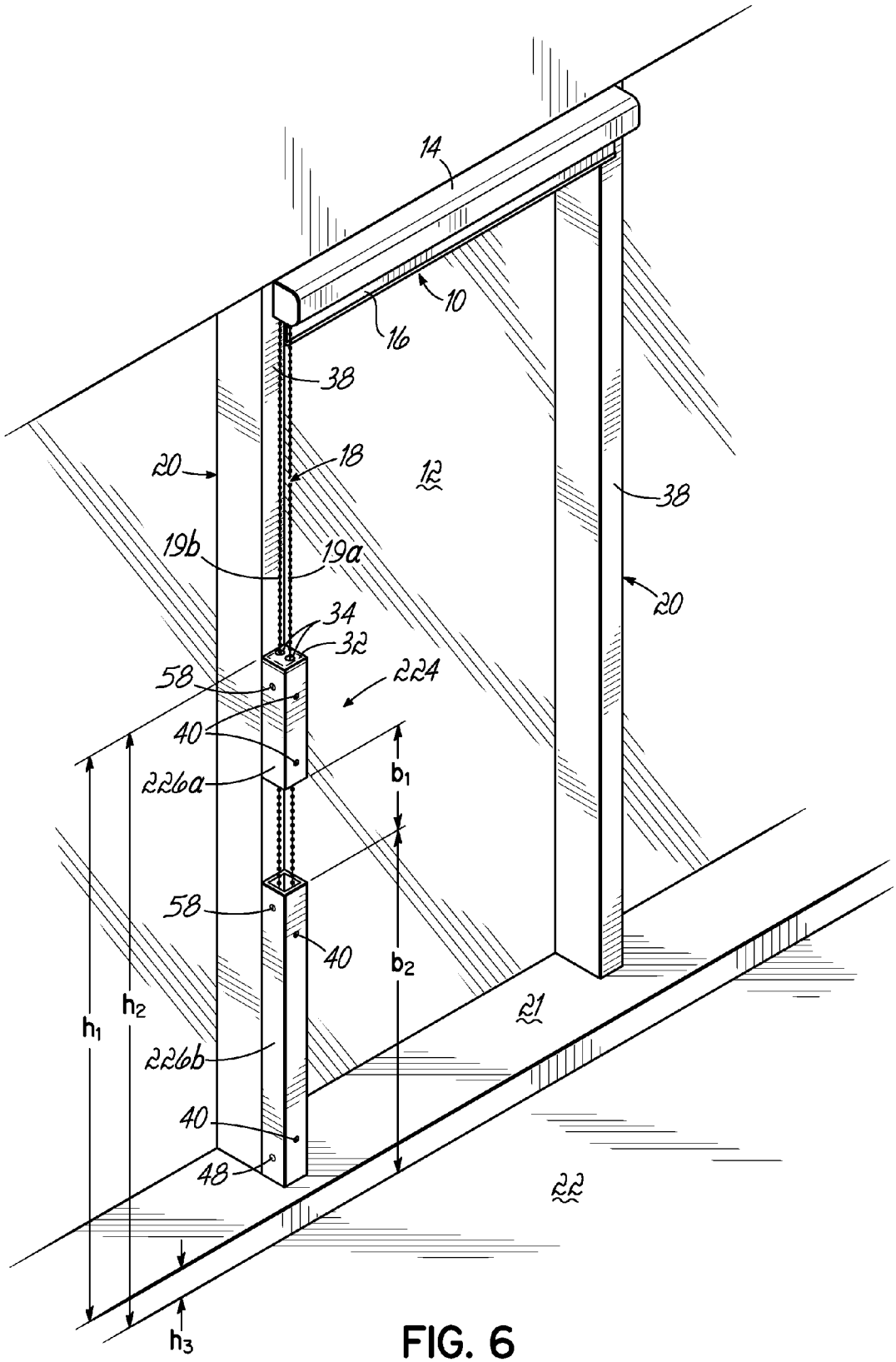
FIG. 6 is a perspective view of a control loop safety device according to yet another embodiment of the present invention.

As shown in FIG. 1, the upper end of the safety device 24 includes an access opening 30 through which the control loop 18 extends into the channel 28. As shown in FIG. 6, a cap 32 having one or more apertures 34 formed therein (two shown) may be mounted to the upper end of the elongated housing 26 to cover the access opening 30. The pair of apertures 34 are configured to allow the pair of vertical runs 19*a* and 19*b* of the control loop 18 to pass therethrough and into the channel 28. The cap 32 may prevent the deposit and/or accumulation of undesirable items within the elongated housing 26. While only one cap 32 (FIG. 6) is shown covering the access opening 30, it will be understood that a second cap (not shown) may be mounted at the lower end of the elongated housing 26. Though not specifically shown, the cap 32 may be mounted to the elongated housing 26 with screws, rivets, or other suitable fasteners, or by glue or a frictional fit. Generally, the cap 32 may be attached to the elongated housing 26 after installation and may be removable to aid in disassembly of the safety device 24 should removal be desired.

The length "$h_1$" of the elongated housing 26 may vary as needed to position the access opening 30 at a height "$h_2$" from a floor 22. Generally "$h_2$" is selected such that the access opening 30 is located within the range of about 48 inches to about 60 inches above the floor 22 so that the access opening 30 is located above the head of most small children. If the base 22 of the mullions 20 has a height "$h_3$" above the floor 22, then the length "$h_1$" of the elongated housing 26 would equal "$h_2$" minus "$h_3$" (for example, 60 inches minus "$h_3$"). Alternatively, it will be appreciated that if the safety device 24 is installed above a window sill (not shown), the length "$h_1$" of the elongated housing 26 would equal "$h_2$" minus the height of the window sill above the floor 22.

Figure 2:
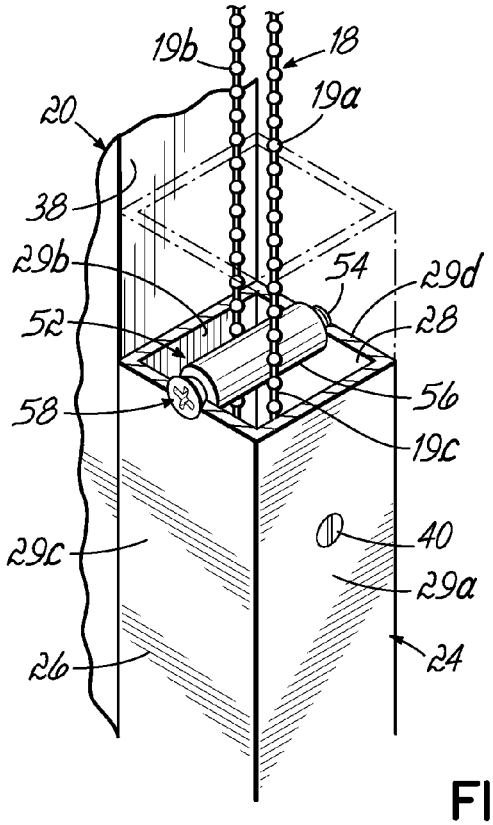
FIG. 2 is an enlarged perspective view, partially broken away, of the encircled area 2 shown in FIG. 1.
Figure 4:
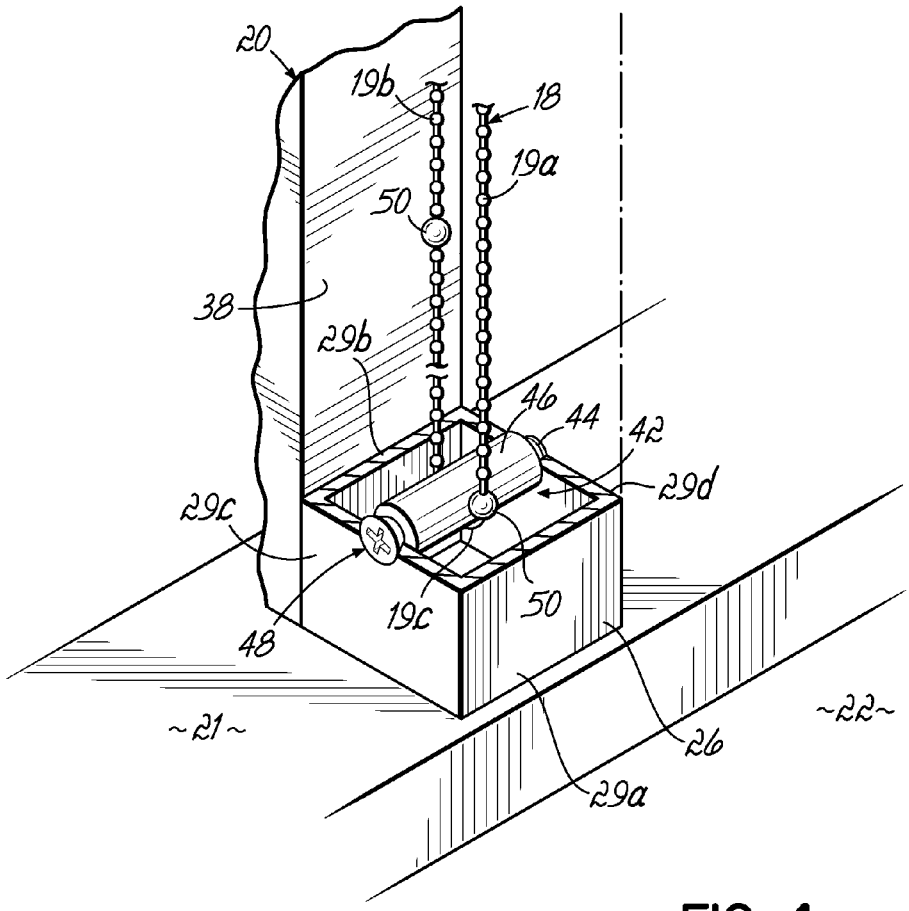
FIG. 4 is a view similar to FIG. 2, showing an enlarged perspective view of the encircled area 4 shown in FIG. 1.

With continued reference to FIGS. 1, 2 and 4, one embodiment of the safety device 24 is shown. The safety device 24 is configured to be mounted in a vertical orientation to one of the pair of mullions 20 adjacent one side of the roller shade 10.

The elongated housing 26 may be mounted to a front face 38 of the mullion 20 by a pair of spaced apart fasteners 40, such as three-inch Bugle head self-drill mounting screws that are located in countersunk holes provided on the front wall 29*a* of the elongated housing 26. The fasteners 40 may be located approximately 3 inches from the ends of the elongated housing 26, and generally along a centerline of the front and rear walls 29*a* and 29*b*, respectively, although other locations of the fasteners 40 are possible as well according to the particular design of the elongated housing 26 and the mullion 20.

In one embodiment as shown in FIGS. 1 and 4, a tension member 42 is mounted within a lower end of the channel 28 and fixed in a vertical location relative to the elongated housing 26. An exemplary tension member 42 includes a cross-shaft 44 extending generally horizontally across the channel 28 and a tubular sleeve 46 mounted on the cross-shaft 44. The cross-shaft 44 may comprise in one embodiment a fastener 48, such as a two-inch machine screw of 10-24 twist with a Phillips head that is countersunk on one side and thread tapped to 10-24 on the opposing side. The fastener 48 may be located approximately 1 inch above the lower end of the elongated housing 26, and generally along a centerline of the side walls 29*c* and 29*d*, respectively, although other locations of the fastener 48 are possible as well. In other embodiments, the cross-shaft 44 may comprise a bolt, pin, peg, dowel or any other suitable structure for mounting the tubular sleeve 46 within the channel 28.

The tubular sleeve 46 may comprise a plastic sleeve and have a length generally corresponding to the internal cross-width dimension of the channel 28. In one embodiment, the tubular sleeve 46 has a length between about 1⅝ inches and about 1¾ inches, an inside diameter of about ¼ inch and an outside diameter of about ⅜ inch. The tubular sleeve 46 may be dimensioned so as to be mounted for rotation on the cross-shaft 44. Of course, other dimensions of the tubular sleeve 46 are possible as well.

When the control loop 18 is installed in the elongated housing 26 of the safety device 24 as shown in FIGS. 1, 2 and 4, the end loop 19*c* of the control loop 18 engages the tension member 42, and the tubular sleeve 46 allows the end loop 19*c* to slide past the sleeve 46 and therefore not interfere with operation of the control loop 18.

As shown in FIG. 4, the control loop 18 may be provided with control beads 50 on each of the pair of vertical runs 19*a* and 19*b* that engage the tubular sleeve 46 during operation of the control loop 18. The control beads 50, if present, serve to limit operation of the control loop 18 beyond preset fully open and fully closed positions. In this way, the tension device 42 secures the control loop 18 within the elongated housing 26 and reduces slack, while effectively providing tension to the control loop 18 that reduces the likelihood of entanglement or strangulation by a small child as will be described in greater detail below.

Referring now to FIGS. 1 and 2, the safety device 24 further includes in one embodiment an alignment member 52 mounted within an upper end of the channel 28 and fixed in a vertical location relative to the elongated housing 26. An exemplary alignment member 52 includes a cross-shaft 54, similar to cross-shaft 44, extending generally horizontally across the channel 28 and a tubular sleeve 56 mounted on the cross-shaft 54. The cross-shaft 54 may comprise in one embodiment a fastener 58, such as a two-inch machine screw of 10-24 twist with a Phillips head that is countersunk on one side and thread tapped to 10-24 on the opposing side. The fastener 58 may be located approximately 1 inch below the upper end of the elongated housing 26, and generally along a centerline of the side walls 29*c* and 29*d*, respectively, although other locations of the fastener 58 is possible as well. In other embodiments, the cross-shaft 54 may comprise a bolt, pin, peg, dowel or any other suitable structure for mounting the tubular sleeve 56 within the channel 28.

The tubular sleeve 56, similar to the tubular sleeve 46, may comprise a plastic sleeve and have a length generally corresponding to the internal cross-width dimension of the channel 28. In one embodiment, the tubular sleeve 56 has a length between about 1⅝ inches and about 1¾ inches, an inside diameter of about ¼ inch and an outside diameter of about ⅜ inch. The tubular sleeve 56 may be dimensioned so as to be non-rotatable on the cross-shaft 54. Of course, other dimensions of the tubular sleeve 56 are possible as well.

When the control loop 18 is installed in the elongated housing 26 of the safety device 24 as shown in FIGS. 1, 2 and 4, the alignment member 52 is located between the pair of vertical runs 19*a* and 19*b* of the control loop 18 to separate the pair of vertical runs 19*a* and 19*b* within the channel 28. The plastic sleeve 56 serves as a guide for the control loop 18 to prevent twisting of the vertical runs 19*a* and 19*b* in the elongated housing 26 and forcing proper alignment of the control loop 18 with the control assembly (not shown) of the roller shade 10.

In accordance with the principles of the present invention, the safety device 24 is mounted to the mullion 20 via the pair of fasteners 40 so that the access opening 30 is located between about 48 inches and about 60 inches above the floor 22. The control loop 18 is installed in the elongated housing 26 of the safety device 24 so that the pair of vertical runs 19*a* and 19*b* extend on opposite sides of the alignment member 52 and the tension member 42 and are connected to the control assembly (not shown) provided in the headrail 14. In this way, the safety device 24 encloses the control loop 18 within the elongated housing 26 so that the vertical runs 19*a* and 19*b* of the control loop 18 are only accessible by an operator, such as an adult or older child, above the access opening 30 at a height in the range of about 48 inches and about 60 inches above the floor 22. This significantly reduces the likelihood that small children could become entangled with or strangled by the control loop 18 since access to the control loop 18 is prevented below a height in the range of about 48 inches and about 60 inches above the floor 22.

While not shown, it will be appreciated that a dual version of the safety device 24 is possible having an elongated housing 26 defining a single elongated channel 28 therein, a pair of horizontally spaced apart alignment members 52 located in the upper end of the elongated housing 26 and a pair of horizontally spaced apart tension members 42 located in the lower end of the elongated housing 26. Each alignment member 52 and tension member 42 of a respective pair operates with a respective control loop 18 in the manner described in detail above so that the safety device 24 is able to accommodate a pair of control loops 18 when two window coverings are present covering a single window, or the window covering includes one control loop 18 for raising and lowering the window covering and another control loop 18 to rotate slats of the window covering variably between open and closed positions.

Figure 5:
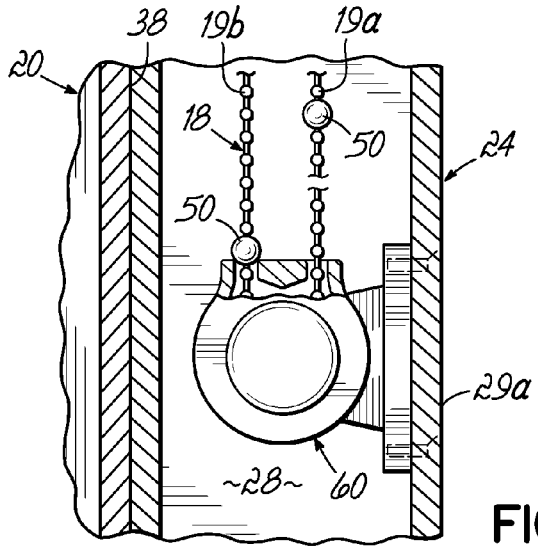
FIG. 5 is a longitudinal cross-sectional view of a control loop safety device in accordance with another embodiment of the present invention.

In an alternative embodiment of the safety device 24 as shown in FIG. 5, the tension member 42 may not be used and rather a rotatable control loop tensioner 60 of conventional design may be mounted within the elongated housing 26. The control loop tensioner 60 engages the end loop (not shown) of the control loop 18 and provides tension to the control loop 18 in a known manner.

Figure 3:
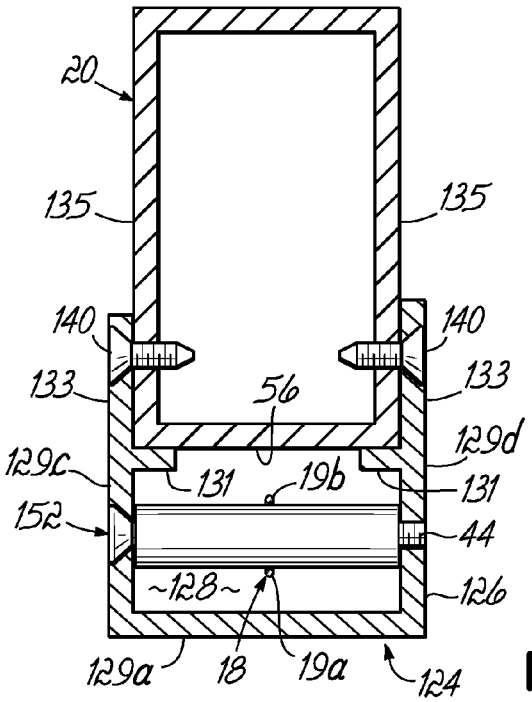
FIG. 3 is a transverse cross-sectional view of a control loop safety device, shown installed on a mullion of a window, according to another embodiment of the present invention.

Referring now to FIG. 3, a control loop safety device 124 is shown according to another embodiment of the present invention. In this embodiment, the safety device 124 has a generally U-shaped, rigid, elongated housing 126 comprising a front wall 129*a*, a pair of opposite sidewalls 129*c* and 129*d*, and a stop member 131 extending inwardly from each of the side walls 129*c* and 129*d*. The elongated housing 126 of this embodiment does not have a rear wall. The elongated housing 126 defines an elongated channel 128 therein, similar to channel 28. The safety device 124 also includes a tension member (not shown) located in a lower end of the housing 126, similar to tension member 42, and an alignment member 152 located in an upper end of the channel 128, similar to the alignment member 52.

As shown in FIG. 3, the safety device 124 is configured to be mounted on a front face 38 of a mullion 20, with the pair of stops 131 engaging the front face 38 of the mullion 20. Each of the side walls 129*c* and 129*d* includes a mounting flange 133 that confronts or engages a respective side face 135 of the mullion 20. Fasteners 140 are provided that extend through the pair of mounting flanges 133 of the safety device 124 and the side faces 135 of the mullion 20 to install the safety device 124 to the mullion 20.

While the mounting of the safety device 124 to the mullion 20 differs from that of the safety device 24, once installed, the safety device 124 operates in a similar manner to the safety device 24 for enclosing the control loop 18 within the elongated housing 126 so that the vertical runs 19*a* and 19*b* of the control loop 18 are only accessible by an operator, such as an adult or older child, above the access opening 30 at a height in the range of about 48 inches and about 60 inches above the floor 22.

While the control loop safety devices 24 and 124 as fully described above provide the benefit of limiting a small child's access to the control loop 18, the particular embodiments of the safety devices 24 and 124 may not be readily suitable for operators who are disabled. For example, an operator who is restricted to a wheelchair may not be capable of reaching the control loop 18 at a height in the range of about 48 inches and about 60 inches above the floor 22. However, an alternative embodiment of a safety device 224 as shown in FIG. 6 provides the desired child safety features of safety devices 24 and 124 described above but allows easy operation of the control loop 18 by a disabled operator.

In the safety device 224 of FIG. 6, the safety device 224 comprises a pair of rigid, vertically spaced apart and elongated upper and lower housings 226*a* and 226*b*, rather than a single elongated housing as shown in the embodiments of the safety devices 24 and 124. Each of the upper and lower elongated housings 226*a* and 226*b* are mounted in a fixed vertical orientation adjacent one side of the roller shade 10 and define respective longitudinal channels (not shown) within the housings 226*a* and 226*b*. The upper and lower housings 226*a* and 226*b* are separated by a gap 227 having a gap width "$b_1$" in the range of about 12 inches and about 18 inches so that the control loop 18 is accessible by a disabled operator in the gap 227 at a height "$b_2$" of about 36 inches above the floor 22 according to one embodiment. The width of the gap 227 is selected so that a smaller child cannot place his or her head within the gap 227 or otherwise pull the control loop 18 out of the gap 227 so as to become entangled with or strangled by the control loop 18.

The upper elongated housing 226*a* includes an alignment member (not shown) in the upper end of its channel but does not include a tension member in a lower end of its channel. The upper elongated housing 226*a* includes an access opening at its upper end, shown covered by the cap 32, so that portions of the vertical runs 19*a* and 19*b* of the control loop 18 are received within its channel.

In this embodiment, the access opening (not shown) of the upper elongated housing 226*a* is located at a height in a range of about 48 inches and about 60 inches above the floor 22 such that an adult or older child can readily access the control loop 18 above the access opening while smaller children are protected against accidental entanglement with or strangulation by the control loop 18. Due to the gap 227 provided between the upper and lower elongated housings 226*a*, 226*b*, the control loop 18 is also accessible by a disabled operator at a height of about 36 inches above the floor 22 according to one embodiment.

The lower elongated housing 226*b* may include an alignment member (not shown) in an upper end of its channel and a tension member (not shown) in a lower end of its channel so that other portions of the vertical runs 19*a* and 19*b* and the end loop 19*c* of the control loop 18 are received within its channel.

While not shown, it will be appreciated that a second cap may be mounted at the upper end of the elongated housing 226*b* to prevent the deposit and/or accumulation of undesirable items within the elongated housing 226*b*.

In an alternative embodiment, the gap 227 may be formed by forming a notch in the elongated housing 26 shown in FIG. 1 (e.g., by removing selected portions of the front wall 29*a* and the pair of opposite side walls 29*c*, 29*d* where the gap 227 is to be formed) so that the upper and lower elongated housings 226*a* and 226*b* so as to be connected by a web lying adjacent the front face 38 of the mullion 20 (e.g., the web is formed by a portion of the rear wall 29*b* at the location where the front wall 29*a* and side walls 29*c* and 29*d* have been removed).

As will be readily appreciated, the various embodiments of the safety devices 24, 124 and 224 are relatively simple to manufacture and reduce the potential hazard to small children associated with loose control loops used to operate window coverings. The safety devices 24, 124 and 224 do not interfere with easy operation of the window covering, can be readily installed, and can be constructed to be easily operated by a disabled operator.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicants' invention.

What is claimed is:

1. A safety device for use with a control loop of a window covering, the control loop having a pair of vertical runs and an end loop, comprising:

a rigid elongated housing configured to be mounted in a fixed vertical orientation adjacent one side of the window covering and defining a longitudinal channel therein configured to receive portions of the pair of vertical runs and the end loop of the control loop within the channel, the elongated housing having an access opening located at an upper end thereof through which the control loop extends into the longitudinal channel and being dimensioned in vertical length so that the pair of vertical runs are exposed above the elongated housing so as to be accessible by a user's hand, with the access opening being located within a range of about 48 inches to about 60 inches above a floor configured to support the user;

a tension member mounted within the channel and fixed in vertical location relative to the elongated housing, the tension member being configured to engage the end loop of the control loop to effectively provide tension to the control loop; and an alignment member mounted within the channel and fixed in vertical location relative to the elongated housing, the alignment member comprising a cross-shaft extending generally horizontally across the channel and being spaced vertically from the tension member, the alignment member being configured to separate the pair of vertical runs of the control loop within the channel to effectively align the control loop within the elongated housing.

2. The safety device of claim 1, wherein the tension member comprises a cross-shaft extending generally horizontally across the channel and a tubular sleeve mounted on the cross-shaft.

3. The safety device of claim 2, wherein the cross-shaft comprises a fastener.

4. The safety device of claim 2, wherein the tubular sleeve is mounted for rotation on the cross-shaft.

5. The safety device of claim 1, wherein the tension member is located proximate a lower end of the elongated housing.

6. The safety device of claim 1, wherein the alignment member comprises a tubular sleeve mounted on the cross-shaft.

7. The safety device of claim 6, wherein the cross-shaft comprises a fastener.

8. The safety device of claim 1, wherein the alignment member is located proximate an upper end of the elongated housing.

9. The safety device of claim 1, wherein the elongated housing is made from extruded aluminum.

10. The safety device of claim 1, wherein the elongated housing comprises an access opening provided at an upper end thereof in communication with the channel.

11. The safety device of claim 10, further comprising a cap covering the access opening and having at least one aperture therein configured to receive the control loop therethrough.

12. The safety device of claim 1, wherein the elongated housing defines a single longitudinal channel therein.

13. The safety device of claim 1, wherein the elongated housing comprises a front wall, an opposite rear wall, and a pair of opposite side walls connected to the front and rear walls.

14. The safety device of claim 1, wherein the elongated housing comprises a front wall, a pair of opposite side walls and a stop member extending inwardly from each of the pair of side walls.

15. A safety device for use with a control loop of a window covering, the control loop having a pair of vertical runs and an end loop, comprising:

a first rigid elongated housing configured to be mounted in a fixed vertical orientation adjacent one side of the window covering and defining a first longitudinal channel therein configured to receive portions of the pair of vertical runs of the control loop within the first channel; and a second rigid elongated housing configured to be mounted in a fixed vertical orientation adjacent the one side of the window covering and below the first elongated housing, the second elongated housing defining a second longitudinal channel therein configured to receive other portions of the pair of vertical runs and the end loop of the control loop within the second channel, wherein the first and second elongated housings are spaced vertically from each other so as to be separated by a gap, with the gap being configured to expose the pair of vertical runs of the control loop between the first and second elongated housings so as to be accessible by a user's hand, and with the first and second housings being dimensioned in respective vertical lengths so that the pair of vertical runs are also exposed and accessible above the first elongated housing by a user's hand.

16. The safety device of claim 15, further comprising a tension member mounted within the second channel and fixed in vertical location relative to the second elongated housing, the tension member being configured to engage the end loop of the control loop to effectively provide tension to the control loop.

17. The safety device of claim 16, wherein the tension member comprises a cross-shaft extending generally horizontally across the channel and a tubular sleeve mounted on the cross-shaft.

18. The safety device of claim 15, further comprising an alignment member mounted within at least one of the first and second channels and fixed in vertical location relative to at least one of the first and second elongated housings, the alignment member being configured to separate the pair of vertical runs of the control loop within the at least one first and second channels to effectively align the control loop within the at least one first and second elongated housings.

19. The safety device of claim 18, wherein the alignment member comprises a cross-shaft extending generally horizontally across the at least one first and second channels and a tubular sleeve mounted on the cross-shaft.

20. A method of installing a safety device for use with a control loop of a window covering installed between a pair of vertical mullions, the control loop having a pair of vertical runs and an end loop, comprising:

mounting a rigid elongated housing in a fixed vertical orientation to one of the pair of vertical mullions, the elongated housing defining a longitudinal channel therein and having an access opening located at an upper end thereof;

mounting a tension member within the channel and fixed in vertical location relative to the elongated housing;

inserting the control loop through the access opening and into the channel with the tension member engaging the end loop of the control loop to effectively provide tension to the control loop;

mounting an alignment member within the channel and fixed in vertical location relative to the elongated housing, the alignment member comprising a cross-shaft extending generally horizontally across the channel so as to be vertically spaced from the tension member, the alignment member separating the pair of vertical runs of the control loop within the channel to effectively align the control loop within the elongated housing; and exposing the pair of vertical runs above the housing so as to be accessible by a user's hand, with the access opening being located within a range of about 48 inches to about 60 inches above a floor configured to support the user.

21. The method of claim 20, further comprising the step of mounting an alignment member within the channel and fixed in vertical location relative to the elongated housing with the alignment member separating the pair of vertical runs of the control loop within the channel to effectively align the control loop within the elongated housing.

22. A method of installing a safety device for use with a control loop of a window covering installed between a pair of vertical mullions, the control loop having a pair of vertical runs and an end loop, comprising:

mounting a first rigid elongated housing in a fixed vertical orientation to one of the pair of vertical mullions, the first elongated housing defining a first longitudinal channel therein;

mounting a second rigid elongated housing in a fixed vertical orientation to the one of the pair of vertical mullions below the first elongated housing with the first and second elongated housings being spaced vertically from each other so as to be separated by a gap, the second elongated channel defining a second longitudinal channel therein; and inserting the control loop into the first and second channels with the first channel receiving portions of the pair of vertical runs of the control loop within the first channel and the second channel receiving other portions of the pair of vertical runs and the end loop of the control loop within the second channel, with the gap being configured to expose the pair of vertical runs of the control loop between the first and second elongated housings so as to be accessible by a user's hand, and with the first and second housings being dimensioned in respective vertical lengths so that the pair of vertical runs are also exposed and accessible above the first elongated housing by a user's hand.

* * * * *